US010682751B2

(12) United States Patent
Corn

(10) Patent No.: US 10,682,751 B2
(45) Date of Patent: Jun. 16, 2020

(54) SCREW GUN MULTITOOL

(71) Applicant: Manuel Antonio Corn, Goodyear, AZ (US)

(72) Inventor: Manuel Antonio Corn, Goodyear, AZ (US)

(73) Assignee: Macorn Industries, LLC, Goodyear, AZ (US)

( * ) Notice: Subject to any disclaimer, the term of this patent is extended or adjusted under 35 U.S.C. 154(b) by 249 days.

(21) Appl. No.: 15/799,856

(22) Filed: Oct. 31, 2017

(65) Prior Publication Data

US 2018/0117754 A1 May 3, 2018

Related U.S. Application Data

(60) Provisional application No. 62/415,071, filed on Oct. 31, 2016.

(51) Int. Cl.
*B25F 3/00* (2006.01)
*B25B 21/00* (2006.01)
(Continued)

(52) U.S. Cl.
CPC ..... *B25F 3/00* (2013.01); *B25B 21/00* (2013.01); *B25B 21/002* (2013.01); *B25B 23/04* (2013.01); *B25F 5/021* (2013.01)

(58) Field of Classification Search
CPC ..... B25B 21/00; B25B 21/002; B25B 21/007; B25B 23/04; B25B 23/18; B25B 28/00;
(Continued)

(56) References Cited

U.S. PATENT DOCUMENTS 3,783,955 A * 1/1974 Gill ..... B25F 3/00 173/50
5,101,697 A * 4/1992 Fishback ..... B25B 23/045 81/433

(Continued)

FOREIGN PATENT DOCUMENTS

WO WO-2008028713 A1 * 3/2008 ..... B25B 23/147

OTHER PUBLICATIONS

Machine translation of WO-2008028713-A1, retrieved Aug. 29, 2019 (Year: 2008).*

(Continued)

*Primary Examiner* — Hemant Desai
*Assistant Examiner* — Jacob A Smith
(74) *Attorney, Agent, or Firm* — Inspired Idea Solutions Law Firm; Wayne Carroll

(57) ABSTRACT

A drywall screw gun multitool (10) incorporates a screw gun on a first end and a cutter assembly (60) tool on an opposing end. A user can turn the tool around to switch from the screw gun tool to the cutter assembly (60) tool. The drywall screw gun multitool (10) comprises an electric motor (50) that spins both the screw gun and the cutter assembly (60). A drywall screw gun multitool (10) may also include a dust collector assembly (80) that draws air in from the cutter end (26) of the tool and through a filter (84). A drywall screw gun multitool (10) may also include a light 33 to aid the user in low light conditions and a stud finder (39). The cutter assembly (60) tool and dust collector may be detachably attachable to the housing (20) of the multitool.

6 Claims, 15 Drawing Sheets

(51) Int. Cl.
*B25B 23/04* (2006.01)
*B25F 5/02* (2006.01)

(58) Field of Classification Search
CPC .... B25D 2217/0069; B25F 3/00; B25F 5/021; B27C 5/10; B27C 9/00; B27C 9/005; B26B 11/00
USPC ..... 173/90, 213
See application file for complete search history.

(56) References Cited

U.S. PATENT DOCUMENTS 5,149,230 A * 9/1992 Nett ..... B25B 21/00 408/125
5,224,230 A * 7/1993 Vanicsek ..... B23B 45/003 409/230
5,276,929 A * 1/1994 Mitchell ..... B25B 21/00 173/50
6,601,480 B1 * 8/2003 Habermehl ..... B25B 23/045 227/136
7,497,886 B2 * 3/2009 Walker ..... B04C 5/187 173/71
8,381,832 B1 * 2/2013 Picard ..... B25F 3/00 173/129
2002/0105797 A1 * 8/2002 Navid ..... B25B 23/18 362/120
2007/0131439 A1 * 6/2007 Hashimoto ..... B25F 5/02 173/48
2010/0269353 A1 * 10/2010 Martin ..... B23D 59/006 30/124
2013/0084185 A1 * 4/2013 Langgood ..... F04D 25/0613 416/169 R
2013/0243538 A1 * 9/2013 Hu ..... B25F 5/021 408/16
2017/0282352 A1 * 10/2017 Brull ..... B25F 5/029
2019/0093716 A1 * 3/2019 Innes ..... F04D 25/06

OTHER PUBLICATIONS

Patent Cooperation Treaty, International Search Report, dated Jan. 23, 2018, Alexandria, Virginia, US.
Patent Cooperation Treaty, Written Opinion of the International Searching Authority, dated Jan. 23, 2018, Alexandria, Virginia, US.
Robert Bosch Tool Corporation, DM10 Instruxtion Manual, Jan. 26, 2015 published at https://images-na.ssl-images-amazon.com/images/I/C1ufMNaEnVS.pdf.

* cited by examiner

SCREW GUN MULTITOOL

CROSS REFERENCE TO RELATED APPLICATIONS

This application claims the benefit of priority to U.S. provisional patent application No. 62/415,071, filed on Oct. 31, 2016 and entitled Multitool Drill; the entirety of which is hereby incorporated by reference herein.

BACKGROUND

Field

The invention relates to drywall screw gun multitools and in particular to a drywall screw gun having a cutter and a dust collector.

Background

Installation of drywall is difficult as large sheets of drywall are held in place, aligned with an adjacent sheet or fit into proper position, and fastened with nails or screws. Drywall screw guns have been developed that automatically index screws into position so that a user can insert the screws by simply pressing the head against the drywall and squeezing the trigger. These tools typically have a clutch that disengages the tool when the screw is inserted to a proper depth. Often the drywall has to be cut, such as holes for light fixtures, outlets or vents. This requires the drywall installer to put down the drywall screw gun, locate a cutting tool and cut the drywall. This switching back and forth between tools is time consuming and cumbersome for the user, especially when holding the drywall in place or working on a ladder. In addition, cutting drywall produces a lot of dust that can get into the user's face and eyes, especially when cutting drywall on the ceiling.

SUMMARY OF THE INVENTION

The invention is directed to a drywall screw gun multitool comprising a screw gun on a first end of the tool and a cutter tool on an opposing end. A drywall installer simply has to turn the tool around to switch from the screw gun tool to the cutter tool, thereby saving time and money in drywall installation. In an exemplary embodiment, the drywall screw gun multitool comprises an electric motor that spins both the screw gun and the cutter that are coupled to the single motor for operation. An exemplary drywall screw gun multitool may also comprise a dust collector assembly that draws air in from the cutter end of the tool and through a filter. An exemplary drywall screw gun multitool may also comprise a light to aid the user in low light conditions such as in tight corners or in dimly lit rooms. An exemplary drywall screw gun multitool may comprise a stud finder that will indicate when the screw gun head is located over a stud. An exemplary stud finder may illuminate when the screw gun head is correctly positioned over a stud. The cutter tool and the dust collector may be detachably attachable to the housing of the drywall screw gun multitool.

An exemplary drywall screw gun multitool comprises an electric motor that is powered by a power supply, such as batteries or through a power cord coupled with the tool. The electric motor spins both the screw gun and the cutter tool. In an exemplary embodiment, the electric motor spins a single drive shaft that extends through the motor and is coupled with the screw gun tool on one end and the cutter tool on the opposing end of the drive shaft. An auto-feed screw assembly may be detachably attachable to the drywall screw gun multitool to feed a screw into the screw gun portion of the tool and align the screw with a screw drive coupling. A user may simply have to press the screw gun end of the tool against the drywall and press the trigger to drive the screw into the drywall. The tool may automatically disengage with the screw when inserted a proper depth, such as by a clutch. A new screw may then be automatically indexed into position.

An exemplary cutter is configured on the opposing end of the drywall screw gun multitool as the screw gun and may be configured into a cutter assembly that is detachably attachable to the drywall screw gun multitool. A cutter may be configured to receive a router shaft and/or a cutter bit. The router shaft and/or cutter bit may be detachably attachable and may be configured to rotate to a stowed position when the user is using the screw gun tool. The router shaft and/or cutter bit may rotate down toward the base of the tool for example and may be at least partially stored in a recess within the housing or the cutter assembly. Optionally, the router shaft and/or cutter bit are coupled to the drywall screw gun multitool by flex wires, such as flex wires extending from the router shaft and/or cutter bit to a cutter drive coupling. The cutter bit may be attached to the tool, such as to the router shaft, by a tie bit and optionally a nut. A portion of the router shaft or cutter drive coupling may be threaded to receive the nut to secure the cutter to the tool.

An exemplary drywall screw gun multitool comprises a dust collector that may be configured in a dust collector assembly that is detachably attachable to the multitool. A fan may be driven by the electric motor to draw air in to the dust collector from the cutter end of the tool. Air containing drywall dust from the cutter tool may be drawn into the collector, through one or more filters and forced out through an outlet. A collection portion may collect the debris for removal. An exemplary collector housing is configured to be opened, to allow removal of the filters for cleaning or replacement and for emptying the collection portion of debris. The window may be configured in the collector housing to allow a user to see how much debris is in the collection portion. A collector interface, such as a button or lever, may allow a user to disengage the fan when the user is not using the cutter tool. In an exemplary embodiment, the fan is engaged automatically when the cutter assembly is attached to the tool or when the cutter tool is rotated up from a stowed position. A user may however disengage the fan using the collector interface.

An exemplary drywall screw gun multitool comprises a light that may project light toward the working end of the tool, such as the screw gun end or the cutter end. The light may pivot to allow the user to switch which end the light is projecting. A light may be configured on the dust collector assembly or directly to the housing.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
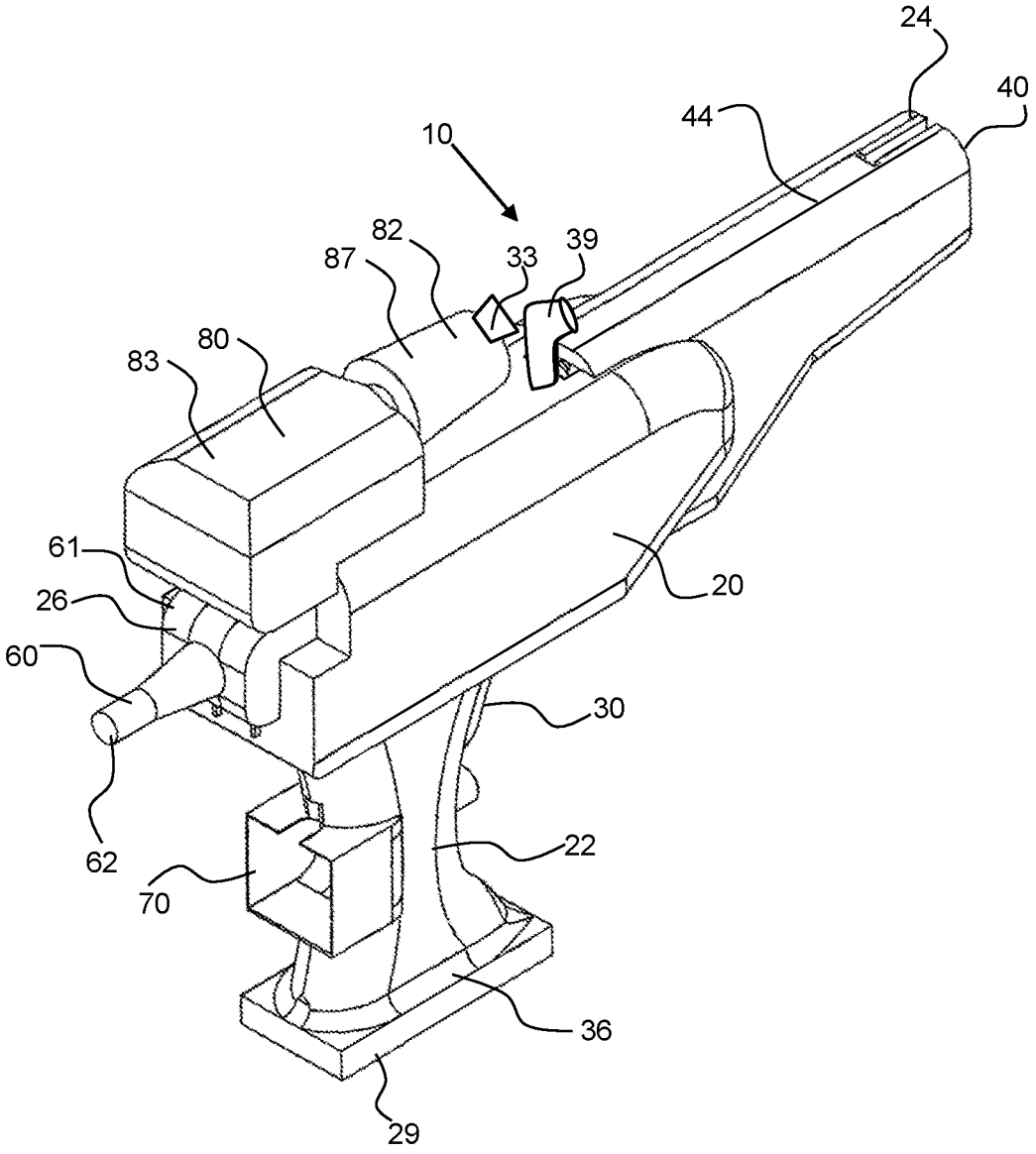
FIG. 1 shows a perspective view of an exemplary drywall screw gun multitool comprising an auto-feed screw assembly on a screw gun end, a cutter assembly attached to the cutter end, and a collector housing configured on top of the multitool.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1 to FIG. 16, in some embodiments a drywall screw gun multitool 10 comprises a screw gun feature 40 that may include an auto-feed screw assembly 44 on a screw gun end 24 of the multitool housing 20, a cutter assembly 60 attached to the cutter end 26, and a dust collector assembly 80, that may include a collector housing 83 configured on top of the multitool. The collector housing 83 has a collector outlet 82 and a collection portion 87 for retaining drywall dust therein. The collector housing may be detachably attachable to the multitool housing 20. Likewise, the cutter assembly 60 may be detachably attachable and may be stored in the cutter housing 70 configured in the handle 22. The cutter assembly comprises a cutter bit 62 that is spun to allow cutting of drywall, such as holes for light fixtures and the like. The exemplary drywall screw gun multitool 10 also comprises a base 29 and a trigger 30 for activating the drive motor 50 to operate the various functions of the drywall screw gun multitool 10.

Figure 7:
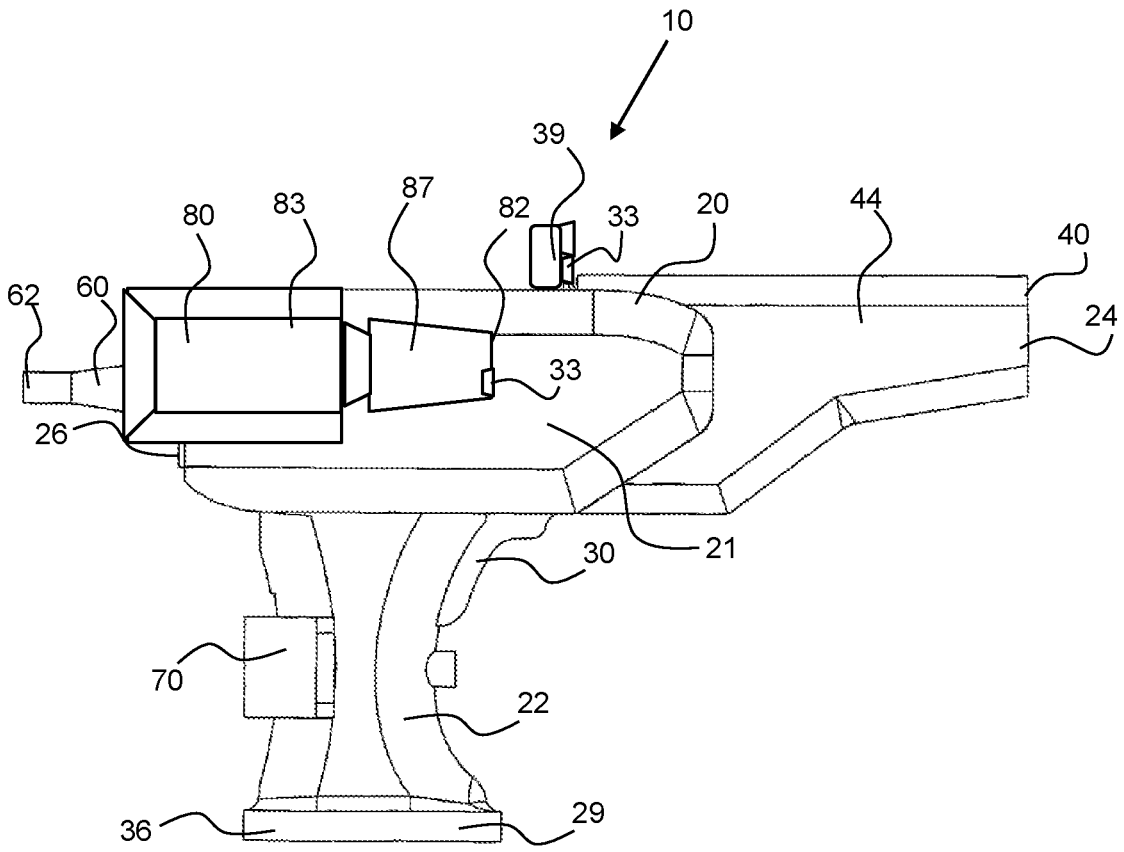
FIG. 7 shows a side view of an exemplary drywall screw gun multitool with the collector housing rotated to one side of the multitool housing.
Figure 8:
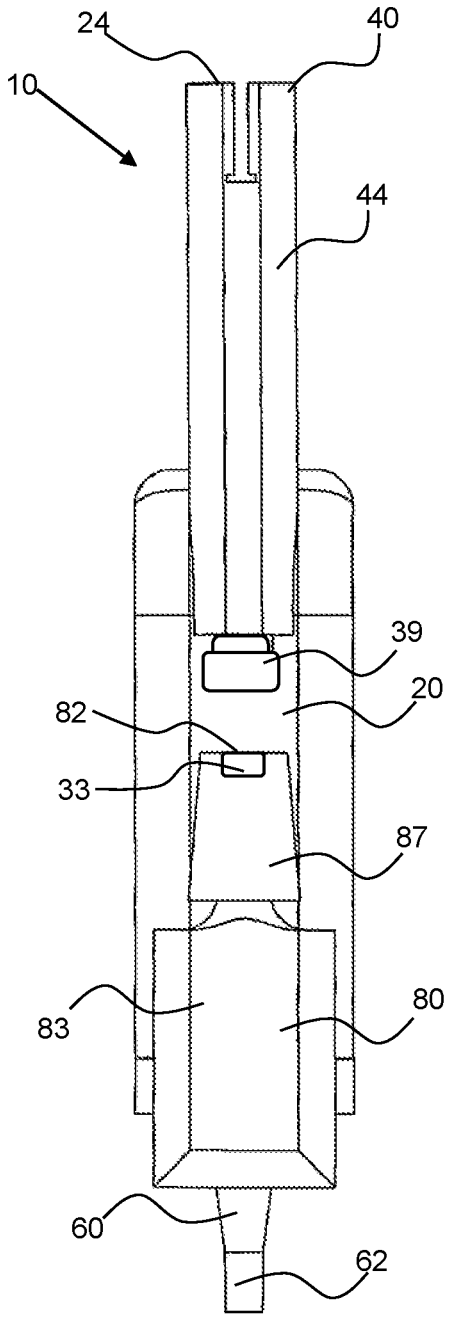
FIG. 8 shows a top view of an exemplary drywall screw gun multitool.
Figure 9:
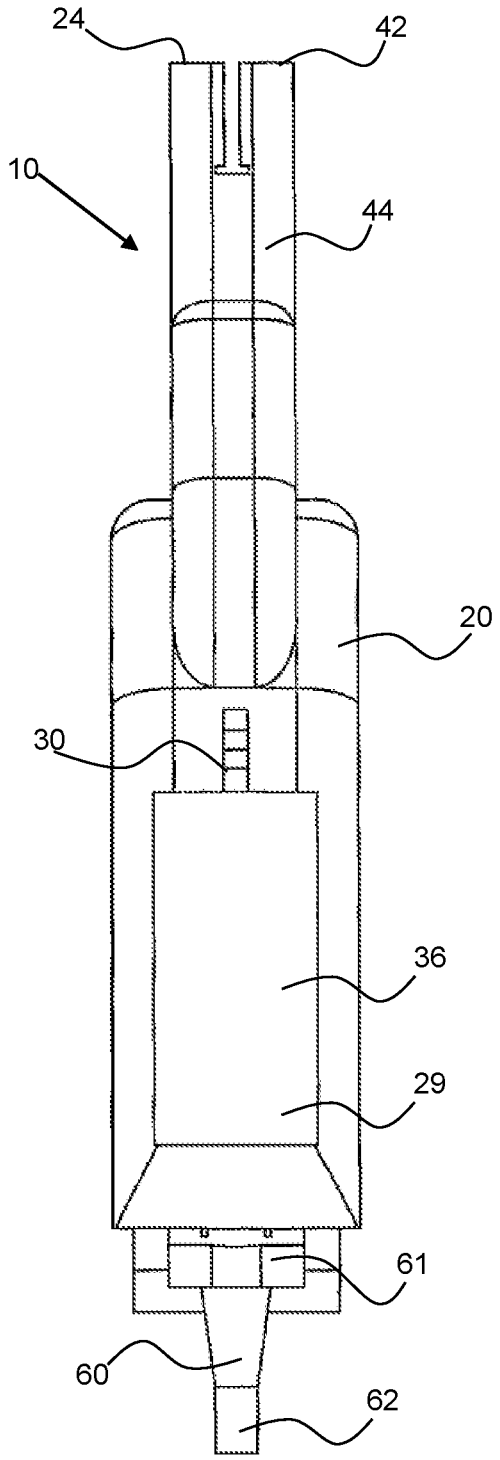
FIG. 9 shows a bottom view of an exemplary drywall screw gun multitool.

As shown in FIG. 7, the collector housing 83 is rotated about the multitool housing 20 to a side 21 of the multitool housing 20. The collector housing may be adjustable in position so that a user can adjust the position of the collector housing 83 to be on the top, or on either of the sides. Allowing the position of the collector housing 83 to be adjustable may allow the drywall screw gun multitool 10 to be used in corners and against walls without the collector housing 83 interfering with the positioning of the drywall screw gun multitool 10. In some embodiments the cutter assembly 60 is round and includes the collector inlet and can rotate relative to the multitool housing 20.

Figure 2:
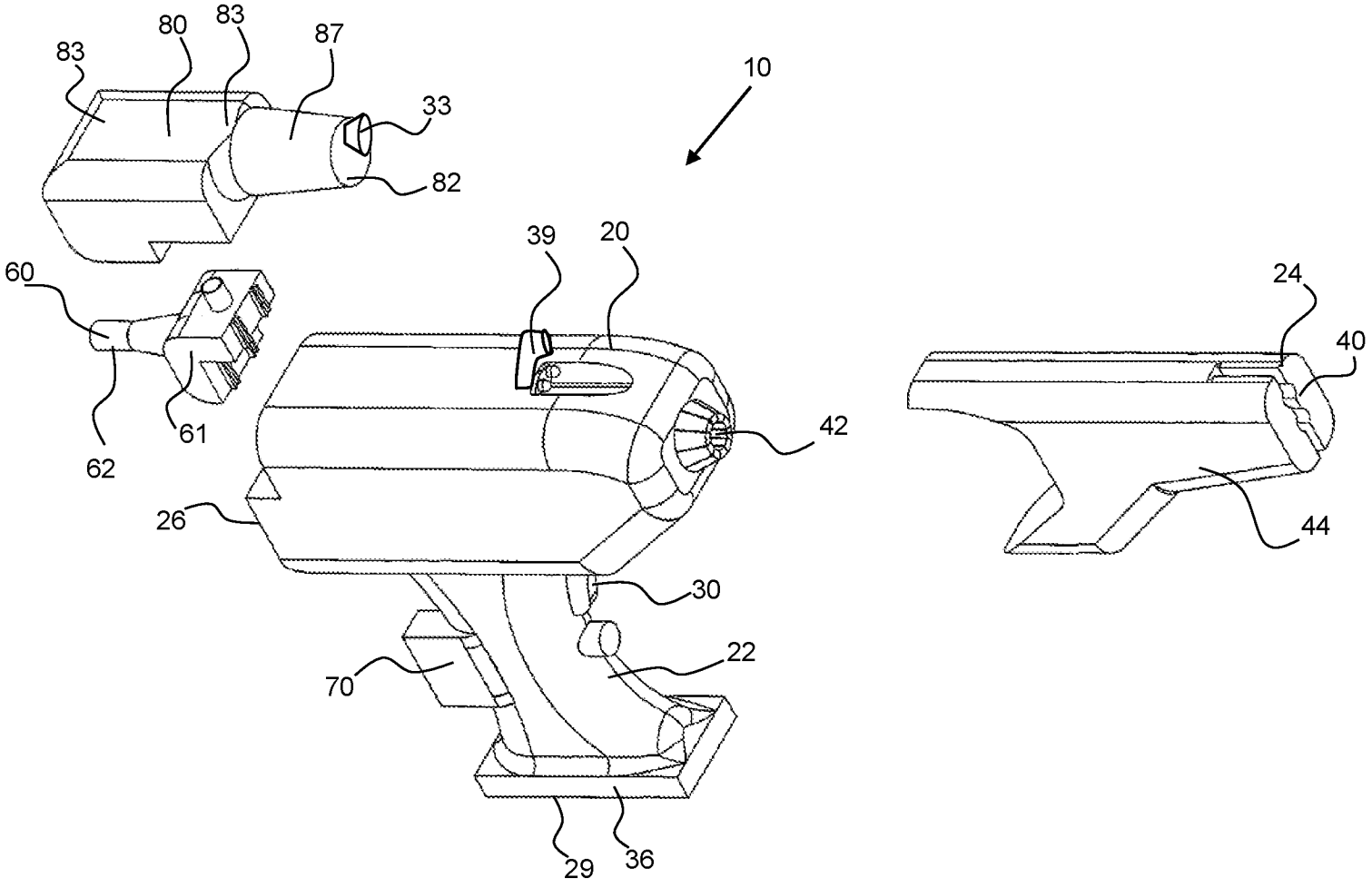
FIG. 2 shows a perspective view of an exemplary drywall screw gun multitool with the auto-feed screw assembly, the cutter assembly and the collector housing detached.
Figure 3:
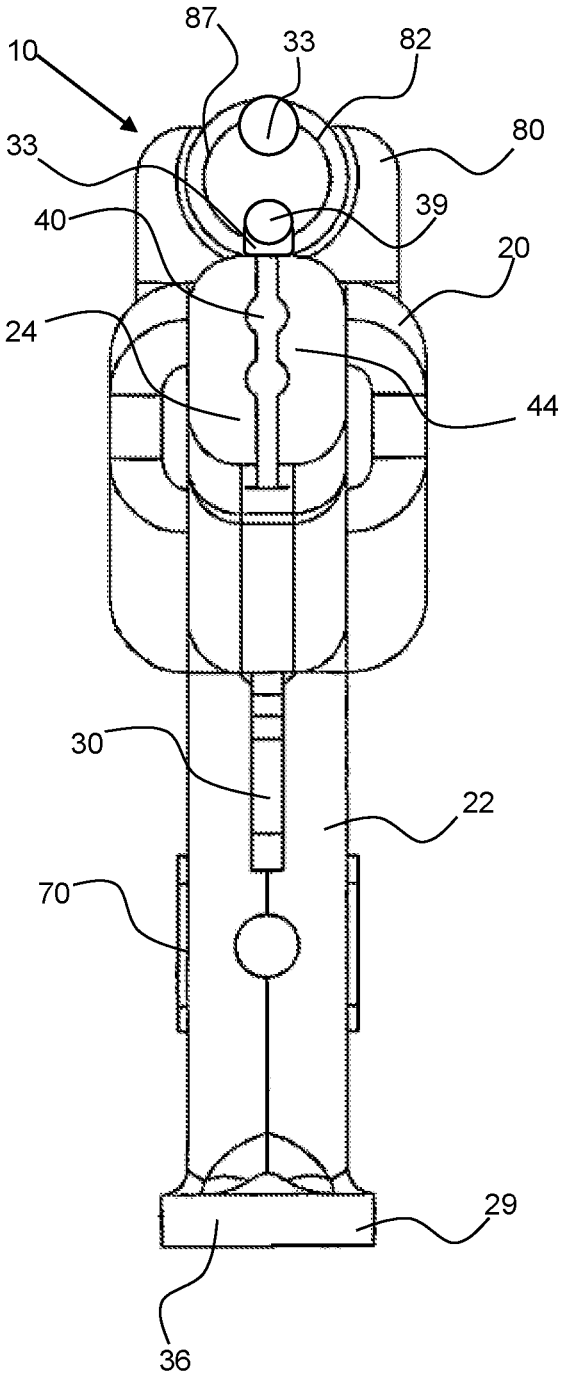
FIG. 3 shows a screw gun end view of an exemplary drywall screw gun multitool.
Figure 4:
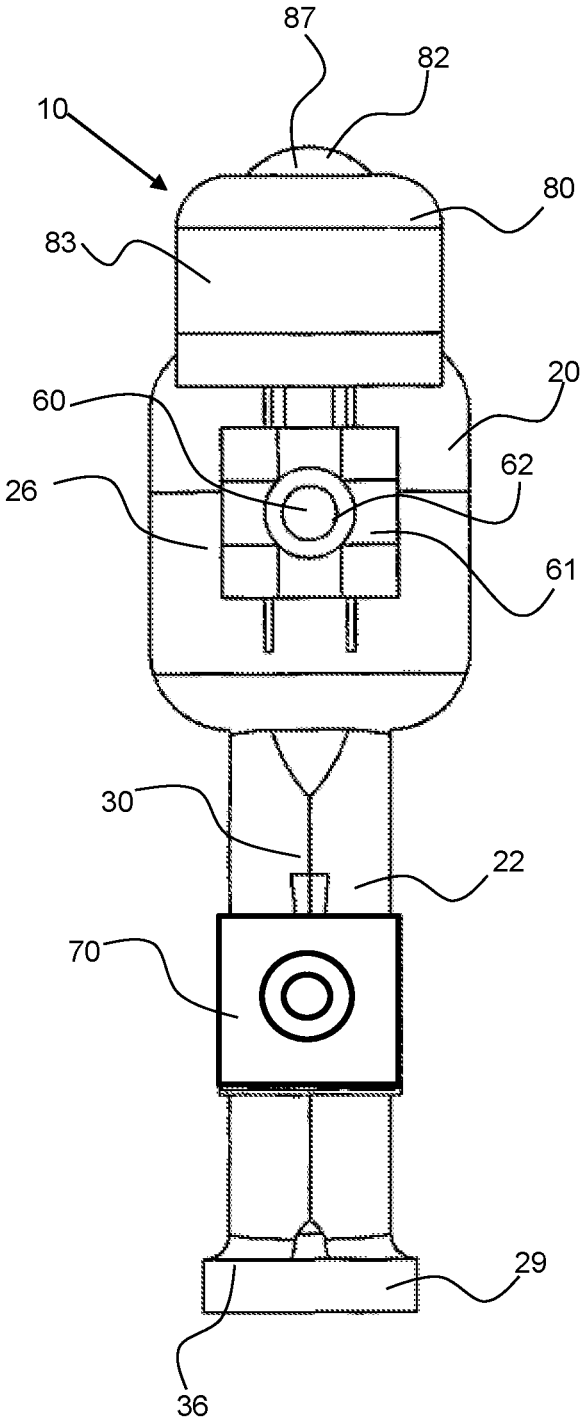
FIG. 4 shows a cutter end view of an exemplary drywall screw gun multitool.

As shown in FIG. 2, the cutter assembly 60 is detached from the multitool housing 20. Also, the collector housing 83 is detached. Also, the auto-feed screw assembly 44 is detached. The screw drive coupling 42 couples with the screw head to drive the screw into drywall.

Figure 5:
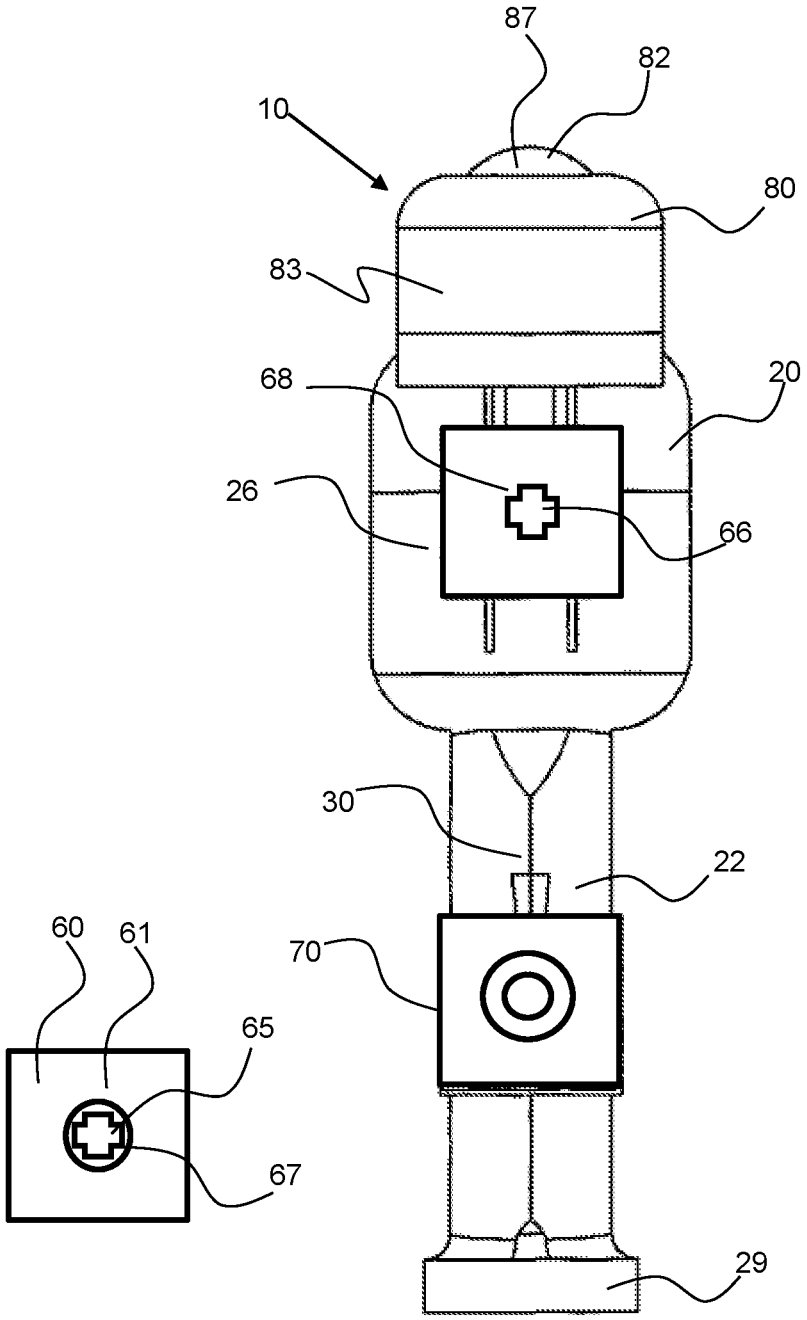
FIG. 5 shows a cutter end view of an exemplary drywall screw gun multitool with the cutter assembly detached.
Figure 6:
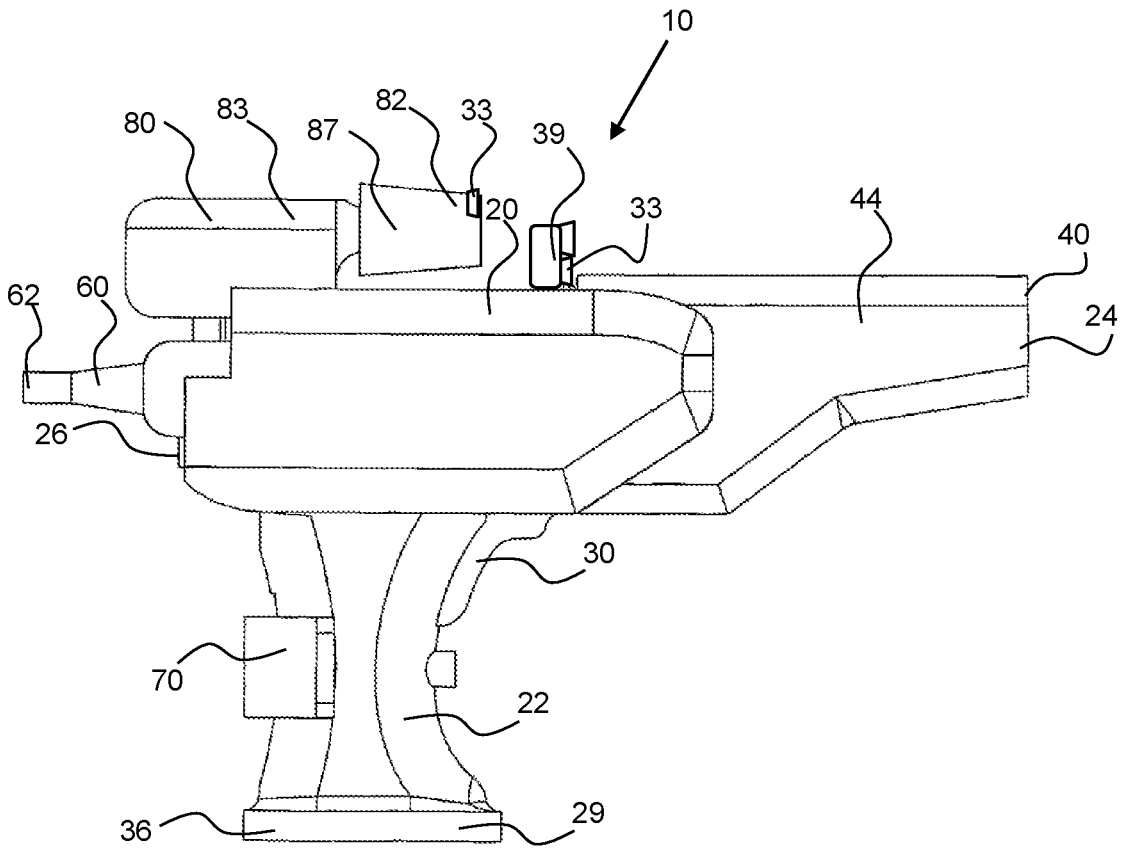
FIG. 6 shows a side view of an exemplary drywall screw gun multitool.

Referring to FIGS. 3 to 9, an exemplary drywall screw gun multitool 10 comprises an auto-feed screw assembly 44 on a screw gun end 24 of the multitool housing 20, a cutter assembly 60 attached to the cutter end 26, and a collector housing 83 configured on top of the multitool. The collector housing 83 has a collector outlet 82 and a collection portion 87 for retaining drywall dust therein. The collector housing 83 may be detachably attachable to the multitool housing 20. Likewise, the cutter assembly 60 may be detachably attachable and may be stored in the cutter housing 70 configured in the handle 22. The cutter assembly comprises a cutter bit 62 that is spun to allow cutting of drywall, such as holes for light fixtures and the like. The exemplary drywall screw gun multitool 10 also comprises a base 29 and a trigger 30 for activating the drive motor to operate the various functions of the drywall screw gun multitool 10. As shown in FIG. 5, the cutter assembly 60 has a cutter coupling 65 that engages with the cutter-drive coupling 66 of the multitool. The cutter coupling 65 may be a protrusion that is inserted into a recess of the cutter-drive coupling. The protrusion and recess may be non-circular in shape and have one or more drive planes, or surfaces to produce torque. The cutter-drive coupling 66 may be a protrusion and the cutter coupling may be a recess. The drive plane 67 of the cutter coupling 65 and the drive plane 68 of the cutter-drive coupling 66 may form shapes that are not circular, for example the drive planes may form a rectangular or star shape or cross shaped cross-section, as shown in FIG. 5.

Figure 10:
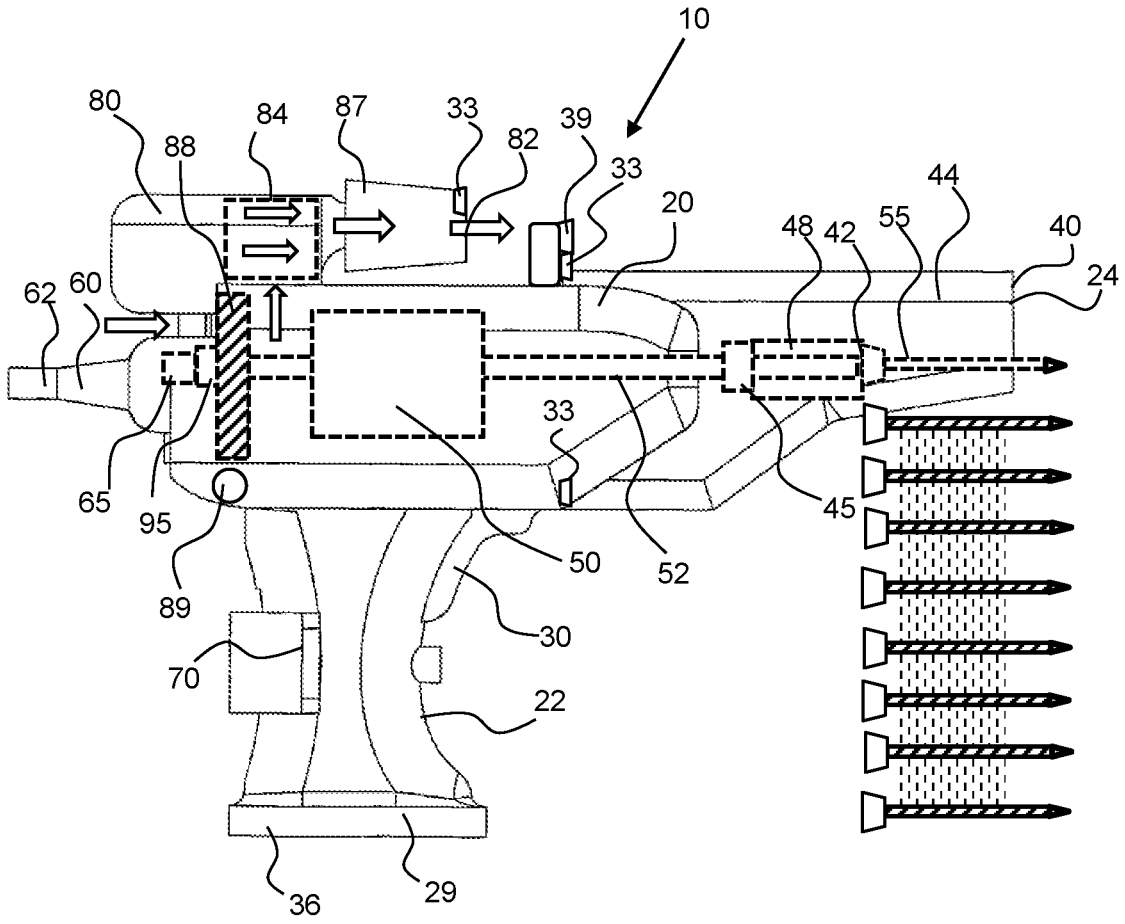
FIG. 10 shows a side view of an exemplary drywall screw gun multitool showing the drive motor and drive shaft and the coupling with the various assemblies.
Figure 11:
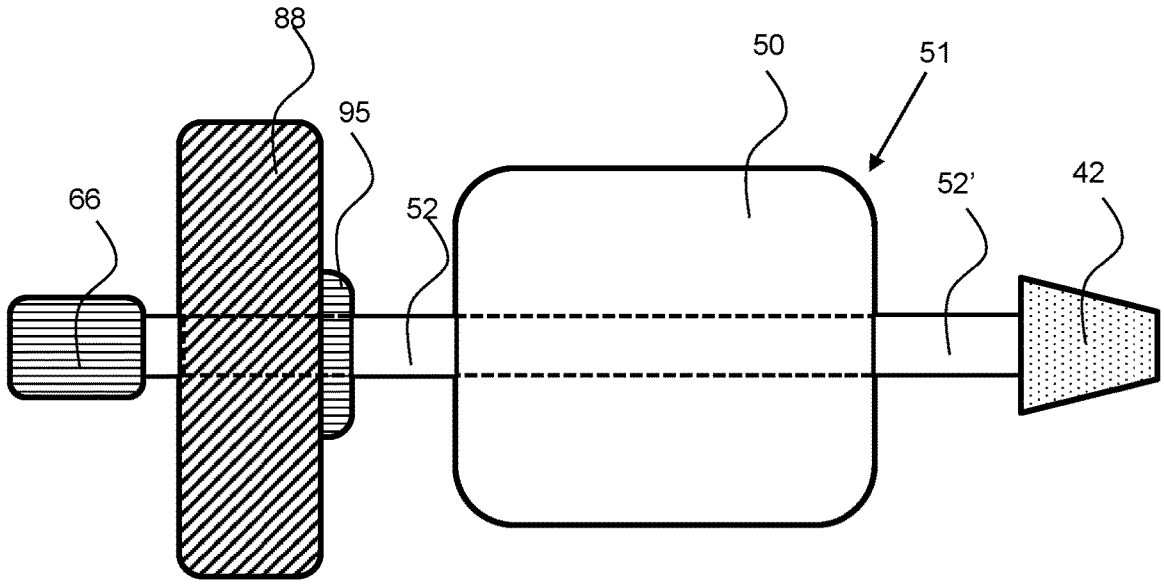
FIG. 11 shows a side view of an exemplary drive motor and drive shaft coupled with a screw drive coupling, a cutter-drive coupling and a fan coupling.
Figure 12:
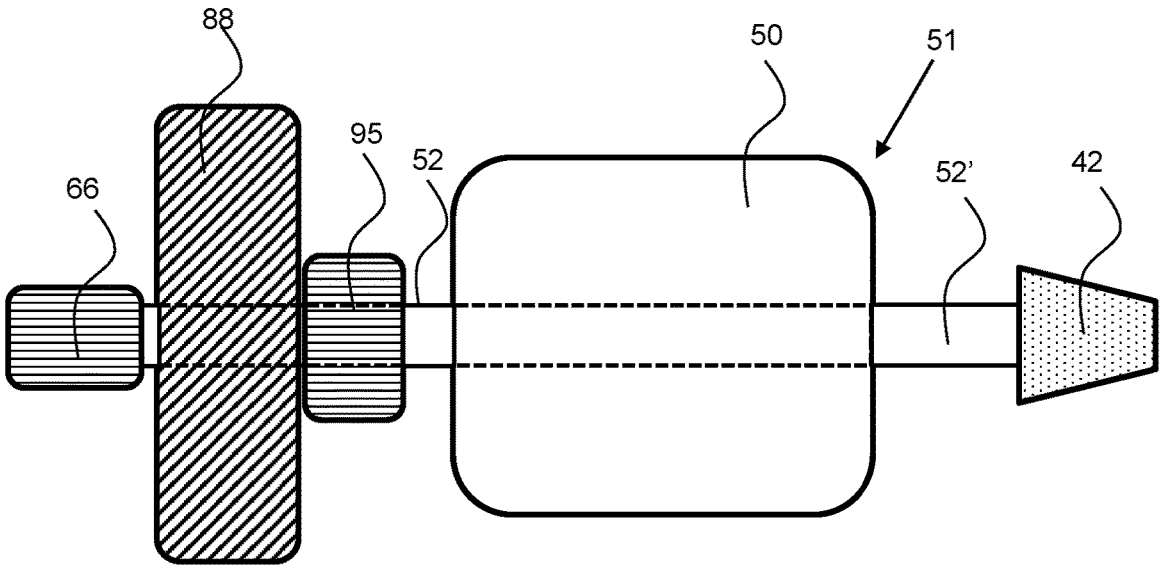
FIG. 12 shows a side view of an exemplary drive motor and drive shaft coupled with a screw drive coupling, a cutter-drive coupling and a fan coupling and the fan disengaged from the fan coupling.

As shown in FIG. 10, FIG. 11 and FIG. 12, in some embodiments a drywall screw gun multitool 10 has a drive motor 50 and a drive shaft 52 that produces the work for the various functions of the multitool. The drive shaft 52 extends from the drive motor 50 and spins the screw drive coupling 42 to drive the drywall screw 55 into drywall. An auto-feed screw assembly 44 pulls a screw into engagement with the screw drive coupling 42 in a successive manner. A series of screws are coupled together by a connector and the auto-feed screw assembly indexes this ribbon of screws to locate a screw in position for coupling with the screw drive coupling 42. The auto-feed screw assembly 44 is also coupled with the drive motor, such as directly to the drive shaft 52 or through an auto-feed coupling 45 coupled with the screw drive coupling 42. A clutch 48 may be configured to disengage the screw drive coupling 42 from the drywall screw 55, after it is driven into the drywall. The drive motor 50 also powers the fan 88 through the fan coupling 95. A collector interface 89 may be used to disengage the fan 88 from the fan coupling 95 so that it does not spin. When the fan 88 is engaged, air is drawn in past the cutter assembly 60, as indicated by the bold arrows, and into the dust collector assembly 80. The dust collector assembly may include one or more filters 84 and a collection portion 87. The air may flow out through the collector outlet 82. The drive motor 50 may also drive the cutter bit 62 through a cutter coupling 65, as described herein.

The drywall screw gun multitool 10 may include an engagement switch that allows the cutter end 26 of the drive shaft 52 to spin with the motor when the cutter bit is engaged with the drive shaft 52, and disengages the screw end of the drive shaft 52 when the cutter bit 62 is engaged with the drive shaft 52. The engagement switch may allow the drywall screw gun multitool to be used in a manner so that only one side of the tool can be used at a time.

As shown in FIGS. 11 and 12, an exemplary drive assembly 51, comprises a motor 50 that drives the drive shafts 52, 52' that extend from opposing sides of the motor 50. As described herein, the drive shaft 52 may be a continuous shaft that extends through the motor. A screw drive coupling 42 is configured on the screw gun end 24 of the drive shaft and a cutter-drive coupling 66 is configured on the opposing cutter end of the drive shaft 52. In some embodiments the cutter-drive coupling does not extend out where it could engage with loose clothing. A fan 88 is coupled to the drive shaft 52 by the fan coupling 95 as shown in FIG. 11, and is disengaged or decoupled from the fan coupling 95 as shown in FIG. 12. A user may use the collector interface 89, as shown in FIG. 10 to engage and disengage the dust collector fan as desired.

Figure 13:
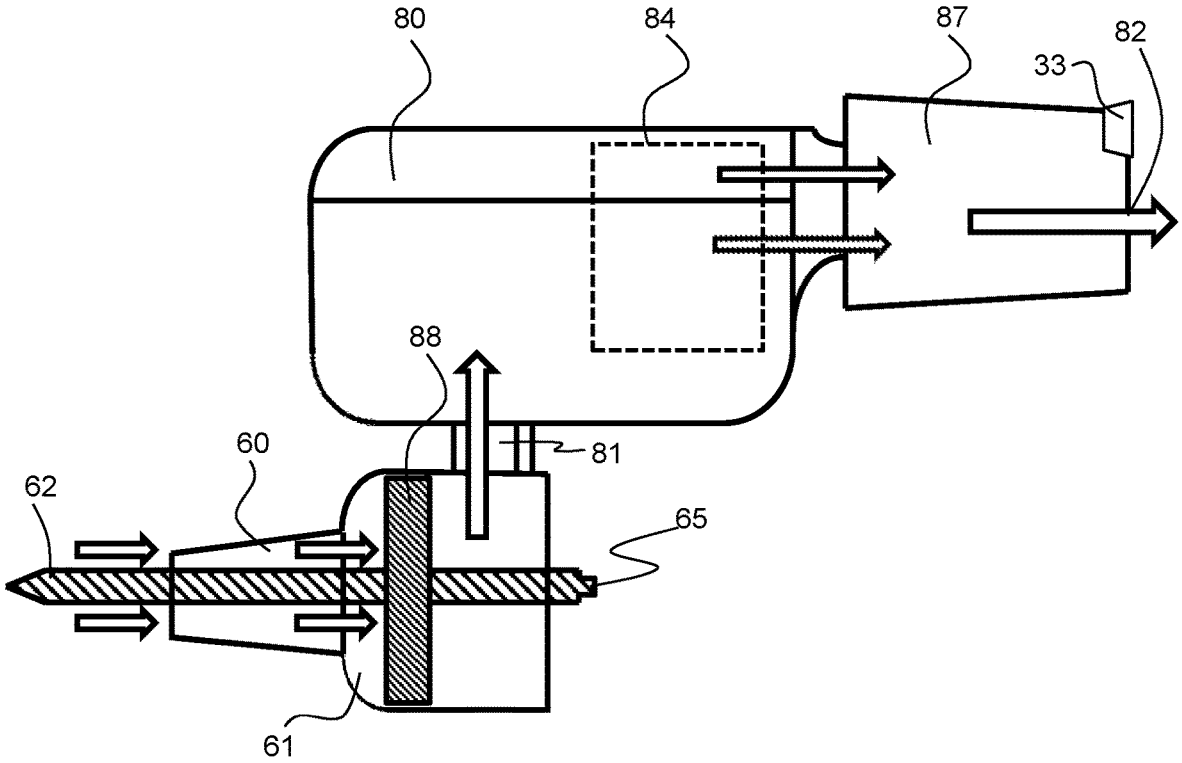
FIG. 13 shows a side view of an exemplary cutter assembly and dust collector assembly including a fan in the cutter assembly.

As shown in FIG. 11, FIG. 12 and FIG. 13, a cutter assembly 60 in some embodiments includes a cutter bit 62 with a fan 88 attached to the cutter bit 62. The cutter bit 62 may include a bearing surface, and the fan 88 may include a bearing that allows the fan 88 to rotate independently of the cutter bit 62. When the cutter bit 62 is rotated by the motor 50, friction between the fan bearing and the bearing surface of the cutter bit 62 will eventually cause the fan 88 to rotate and draw air creating an air flow as shown by the bold arrows. The air flow will pass by the cutter bit 62, pass through the fan 88, and into the collector inlet 81 of the dust collector assembly 80, where the dust may be captured by the filter 84 and collection portion 87 before the air exits the dust collector assembly 80 at the collector outlet 82.

Figure 14:
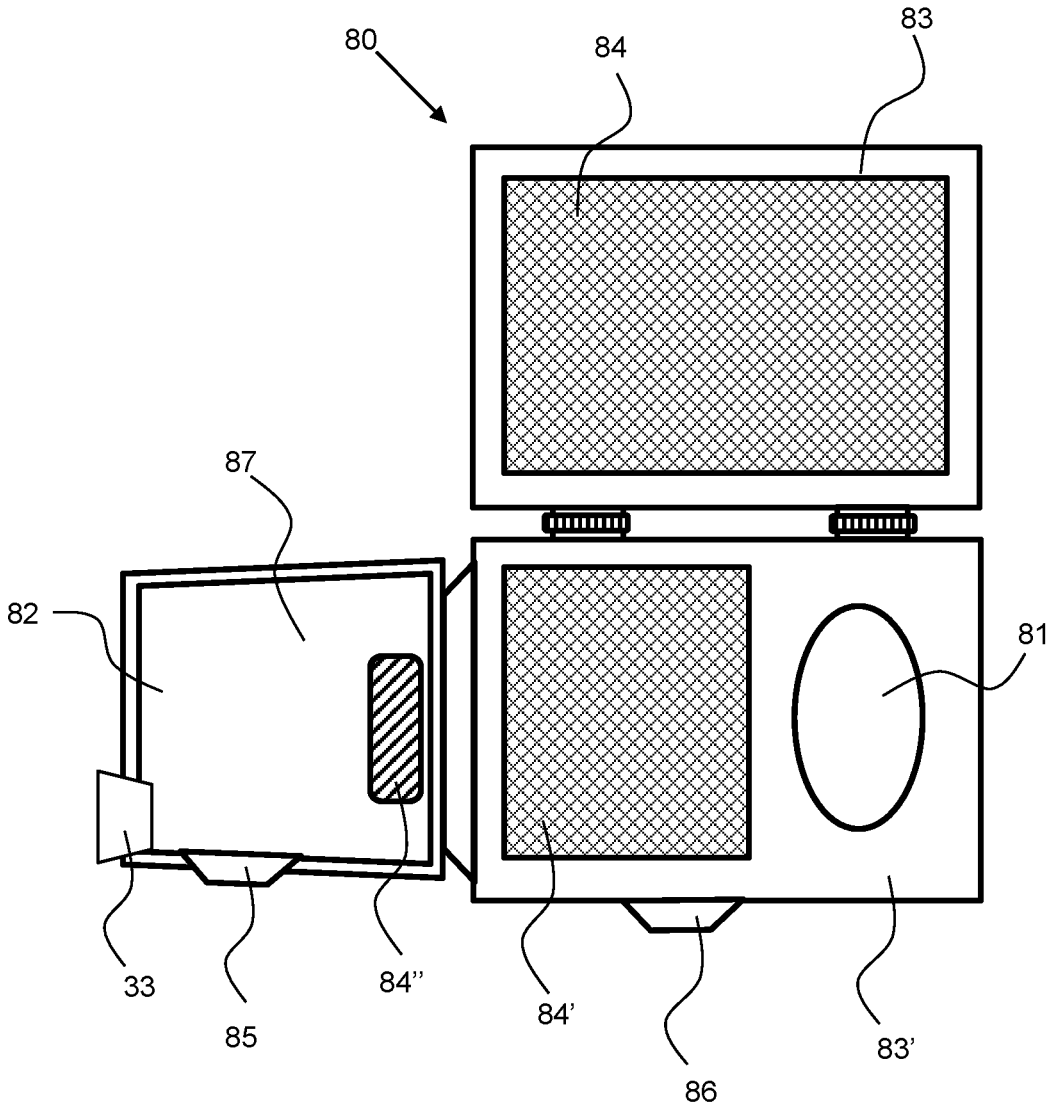
FIG. 14 shows an exemplary collector housing that is opened to show the filter and collection portion.

As shown in FIG. 14, the dust collector assembly 80 comprises a collector housing 83 that can be opened by manipulation of a release feature 86 to expose and remove, replace or clean filter elements 84, 84'. The collector housing has a first portion and a second portion 83, 83'. A collector inlet 81 allows airflow to flow into the dust collector housing. A collection portion 87 may collect dust, such as drywall dust and a window 85 may be used to determine when the collection portion 87 needs to be emptied. Airflow may flow from the collector inlet 81, through the filter 84, into the collection portion 87 and out of a collector outlet 82.

As shown in FIG. 14, the dust collector assembly 80 comprises a housing 83 that can be opened by manipulation of a release feature 86 to expose and remove, replace or clean filter elements 84, 84'. The housing has a first portion and a second portion 83, 83'. A collector inlet 81 allows airflow to flow into the dust collector housing. A collection portion 87 may collect dust, such as drywall dust and a window 85 may be used to determine when the collection portion 87 needs to be emptied. Airflow may flow from the collector inlet 81, through the filter 84, into the collection portion 87 and out of a collector outlet 82.

Figure 15:
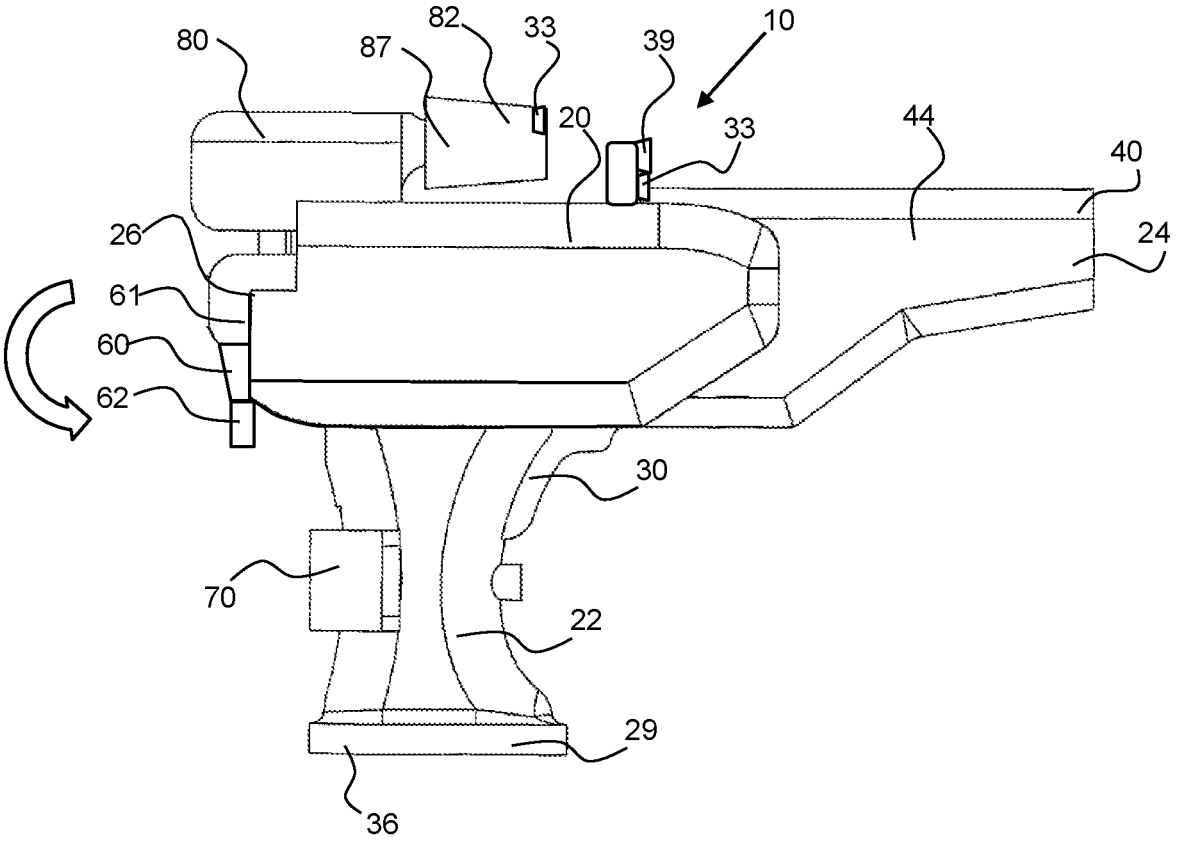
FIG. 15 shows an exemplary drywall screw gun multitool with the cutter rotated down toward the base of the tool.

As shown in FIG. 15, an exemplary drywall screw gun multitool 10 is configured with the cutter bit rotated down toward the base 29 of the tool. The cutter assembly may rotate or the cutter bit and/or router shaft may rotate down to place the bit in a less obtrusive location. In some embodiments when the cutter bit 62 is rotated down it disengages from the motor so that it will not rotate. Rotating the cutter assembly 60 into down position may allow engagement of the screw gun feature 40, and rotating the cutter assembly 60 into the position where it can be used may disengage the screw gun feature 40. A cutter bit extending from the cutter end 26 of the tool may be cumbersome for the user when they are using the screw gun portion of the tool. The cutter assembly housing 61 may be detachable from the tool as well, as shown in FIG. 2.

Figure 16:
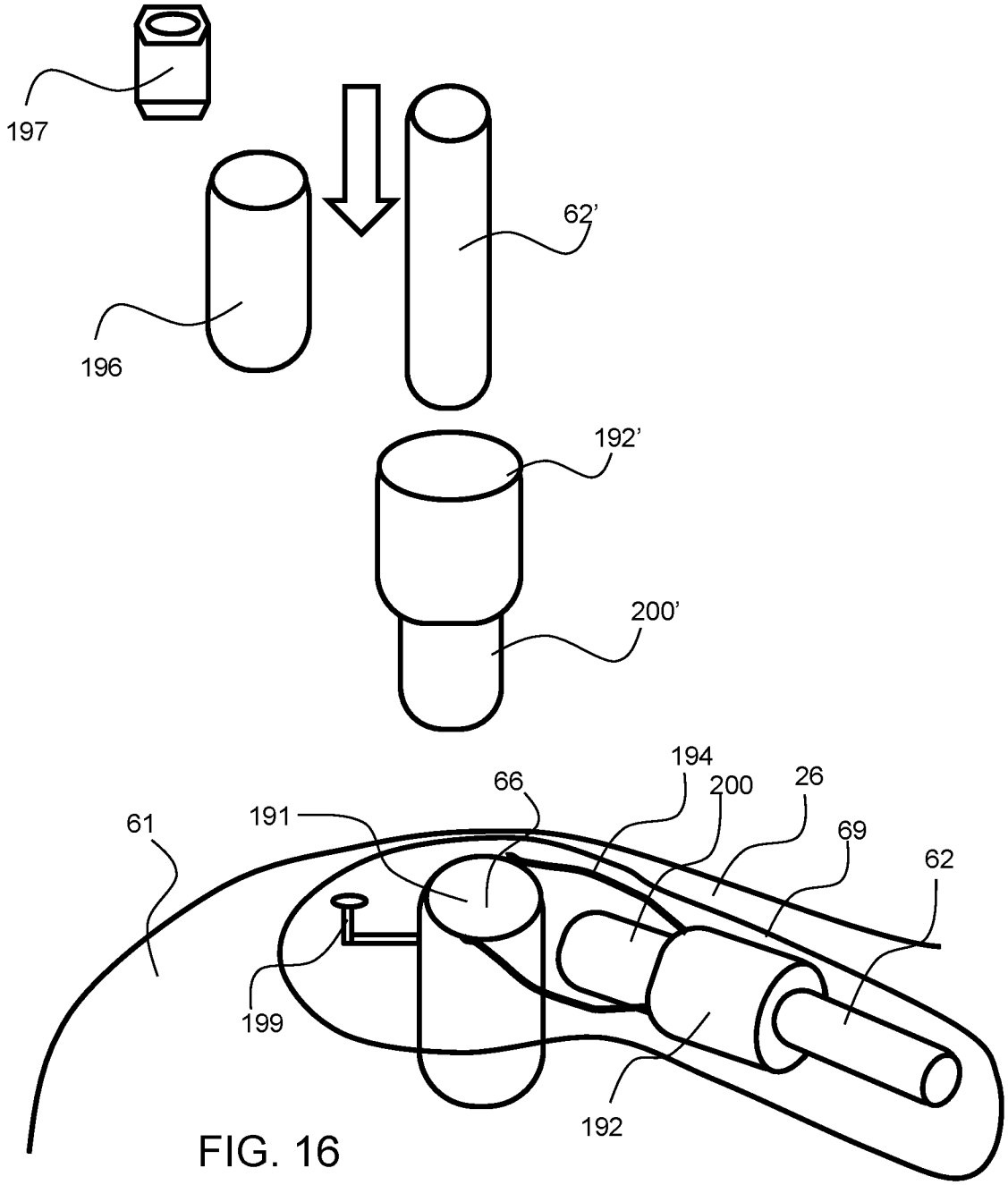
FIG. 16 shows an enlarged view of a cutter assembly having an opening for receiving the router shaft and cutter bit.

As shown in FIG. 16, a cutter bit 62 is stored within an opening 69 within the cutter assembly housing 61. The router shaft 192 is coupled with the shaft receiver 191 or cutter-drive coupling 66, which may extend from the motor drive shaft. A cutter bit 62 may be coupled with the router shaft by a tie bit 196 and nut 197, wherein the cutter bit 62 extends into the router shaft 192. A portion of the router shaft 192 may include a threaded end 200. The cutter bit 62 and router shaft 192 may be coupled to the cutter-drive coupling 66 by flex wires 194 to allow the cutter bit to be stored in the opening 69. A shaft lock 199 may be used to secure the router shaft 192 to the cutter-drive coupling 66.

FIG. 16 also shows an exemplary exploded view with the router shaft 192', the threaded end 200', and the cutter bit 62'. In some embodiments the tie bit 196 is placed inside the router shaft 192', and then the cutter bit 62' is placed inside the tie bit. The nut 197 is slid over the cutter bit 62', or the cutter bit 62' is inserted into the nut and tie bit, and fastened to the router shaft 192' thus causing the tie bit 196 to secure the cutter bit 62'.

An exemplary drywall screw gun multitool comprises a stud finder 39 that alerts the user when the screw gun end is positioned over a stud. A stud finder may produce an indicating light or sound when over a stud. In addition, the stud finder 39 may pivot or rotate allowing the user to determine a stud location when using the cutter tool. A stud finder 39 may utilize sound waves or any conventional means to locate the stud. In some embodiments a light 33 may be mounted with the stud finder 39 and both the light 33 and the stud finder 39 may be rotated together to point to either the screw gun end 24 or the cutter end 26. In other embodiments the stud finder 39 and the light 33 may be on separate components, and the light 33 may rotate independent of the stud finder 39.

An exemplary drywall screw gun multitool may include one or more lights 33 such as an LED (Light Emitting Diode) light. The LED light 33 may be placed in multiple locations including on the screw gun end 24, the cutter end 26, the collector outlet 82, the multitool housing 20, or other places on the drywall screw gun multitool. The light 33 may be an LED an incandescent light, or other type of light. In some embodiments an LED light provides the advantage of lower power usage to extend the life of a battery when a system is operating using a battery as a power supply 36.

In some embodiments a stud finder 39 may include a laser to show on the wall where the stud is on the wall. A stud finder 39 may be located on one or more locations on the drywall screw gun multitool including on the screw gun end 24 and on multitool housing 20.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A screw gun multitool comprising:
- a) a multitool housing comprising:
  - i) a screw gun end and an opposing cutter end;
  - ii) a handle;
  - iii) a trigger;
- b) a motor having a drive shaft that spins;
- c) a screw gun feature configured on the screw gun end of the multitool housing and comprising:
  - i) a screw drive coupling that is coupled with the drive shaft of the motor and that couples with a screw to spin said screw;
- d) a cutter assembly attached to the opposing cutter end of the multitool housing and comprising:
  - i) a cutter coupling that couples with a cutter-drive coupling that is driven by the motor;
  - ii) a cutter bit that detachably attaches to the cutter assembly and is driven by the cutter coupling;
- e) a dust collector assembly comprising:
  - i) a filter configured in a collector housing having a collector inlet for receiving a flow of air from the cutter assembly and an outlet;
  - ii) a fan that is coupled with the motor and spins to draw air and dust past the cutter assembly, through the collector inlet and through said filter and out of said outlet; and
- f) a collector interface that disengages the fan from the motor, whereby the fan will not spin to draw air past the cutter assembly.

2. The screw gun multitool of claim 1, wherein the collector interface moves the fan along length of the drive shaft, to disengage the fan from drive gears coupled to the drive shaft.

3. The screw gun multitool of claim 1, wherein the collector interface impinges on the fan to prevent it from spinning.

4. A screw gun multitool comprising:
- a) a multitool housing comprising:
  - i) a screw gun end and an opposing cutter end;
  - ii) a handle;
  - iii) a trigger;
- b) a motor having a drive shaft that spins;
- c) a screw gun feature configured on the screw gun end of the multitool housing and comprising:
  - i) a screw drive coupling that is coupled with the drive shaft of the motor and that couples with a screw to spin said screw;
- d) a cutter assembly attached to the opposing cutter end of the multitool housing and comprising:
  - i) a cutter coupling that couples with a cutter-drive coupling that is driven by the motor;
  - ii) a cutter bit that detachably attaches to the cutter assembly and is driven by the cutter coupling;
- e) a dust collector assembly comprising:
  - i) a filter configured in a collector housing having a collector inlet for receiving a flow of air from the multitool housing and an outlet;
  - ii) a fan that is coupled with the motor and spins to draw air and dust past the cutter bit, through the collector inlet and through said filter and out of said outlet;
- f) a collector interface that disengages the fan from the motor, whereby the fan will not spin to draw air past the cutter bit;

wherein the cutter assembly is detachably attachable to the multitool housing; and wherein the collector housing of the dust collector assembly is detachably attachable to the multitool housing.

5. The screw gun multitool of claim 4, wherein the collector interface moves the fan along length of the drive shaft, to disengage the fan from drive gears coupled to the drive shaft.

6. The screw gun multitool of claim 4, wherein the collector interface impinges on the fan to prevent it from spinning.

* * * * *